US008736188B2

(12) United States Patent
Klier et al.

(10) Patent No.: US 8,736,188 B2
(45) Date of Patent: May 27, 2014

(54) DETECTOR CIRCUIT AND METHOD FOR CONTROLLING A FLUORESCENT LAMP

(75) Inventors: Juergen Klier, Traunreut (DE); Richard Pfaller, Traunwalchen (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 171 days.

(21) Appl. No.: 13/144,535

(22) PCT Filed: Nov. 13, 2009

(86) PCT No.: PCT/EP2009/065085

§ 371 (c)(1),
(2), (4) Date: Jul. 14, 2011

(87) PCT Pub. No.: WO2010/081570

PCT Pub. Date: Jul. 22, 2010

(65) Prior Publication Data

US 2012/0019146 A1 Jan. 26, 2012

(30) Foreign Application Priority Data

Jan. 16, 2009 (DE) ..... 10 2009 004 851

(51) Int. Cl.
*H05B 41/16* (2006.01)

(52) U.S. Cl.
USPC ..... 315/224; 315/200 R; 315/121; 315/86

(58) Field of Classification Search
USPC ..... 315/121, 210, 200 R, 86, 219, 247, 240, 315/224, 291
See application file for complete search history.

(56) References Cited

U.S. PATENT DOCUMENTS

| | | | | |
|---|---|---|---|---|
| 6,288,500 | B1 * | 9/2001 | Klier | 315/209 R |
| 6,667,584 | B2 * | 12/2003 | Hooijer et al. | 315/224 |
| 7,298,099 | B2 * | 11/2007 | Ribarich | 315/308 |
| 8,212,497 | B2 * | 7/2012 | Yadlapalli et al. | 315/294 |
| 2003/0122506 | A1 | 7/2003 | Kamata et al. | |
| 2003/0168997 | A1 | 9/2003 | Nishimoto et al. | |
| 2005/0168174 | A1 | 8/2005 | Edamura | |
| 2011/0273096 | A1 * | 11/2011 | Klier et al. | 315/121 |
| 2012/0206044 | A1 * | 8/2012 | Cash | 315/86 |
| 2013/0147351 | A1 * | 6/2013 | Trainor et al. | 315/86 |

FOREIGN PATENT DOCUMENTS

| | | | |
|---|---|---|---|
| CN | 1430456 | A | 7/2003 |
| WO | 2006117809 | A1 | 9/2006 |

* cited by examiner

*Primary Examiner* — Vibol Tan

(57) ABSTRACT

A detector circuit for controlling at least one fluorescent lamp is provided, wherein the detector circuit is configured such that an inactive fluorescent lamp can be detected if a first signal is present at least one of a first input and a second signal is present at a second input in a detection interval after a start-up phase.

11 Claims, 5 Drawing Sheets

DETECTOR CIRCUIT AND METHOD FOR CONTROLLING A FLUORESCENT LAMP

RELATED APPLICATIONS

The present application is a national stage entry according to 35 U.S.C. §371 of PCT application No.: PCT/EP2009/065085 filed on Nov. 13, 2009, which claims priority from German application No.: 10 2009 004 851.0 filed on Jan. 16, 2009.

TECHNICAL FIELD

The invention relates to a detector circuit, an electronic ballast, and a method for controlling at least one fluorescent lamp.

BACKGROUND

A possible reason why fluorescent lamps fail is diminished emitting power on the part of the electrodes (what is called the end-of-life effect). Said effect occurs at the end of a fluorescent lamp's useful life in one of the two electrodes. The result is that the discharge current flows through the lamp more readily in one direction than in the opposite direction. The fluorescent lamp functions in that case as a rectifier. The electrode that is unable to emit therein becomes so hot that high temperatures can occur on the lamp's surface. In an extreme case, the glass bulb of small-diameter fluorescent lamps can melt.

An electronic ballast (EB) for actuating the fluorescent lamp must promptly detect said one such fault incident and either limit the output current and output voltage in each case to a non-critical value or switch the fluorescent lamp off.

The EB has to perform various control and monitoring functions beyond actually operating the lamp. Depending in particular on how the EB is connected, control and monitoring functions of such kind require separate circuitry components.

SUMMARY

Various embodiments may avoid the aforementioned disadvantages and e.g. offer an approach to an efficient and flexible electronic ballast or, as the case may be, provide a versatile detector circuit for actuating a lamp which circuit will perform control and/or monitoring functions depending on, for example, the kind of connection mode.

Various embodiments provide a detector circuit for controlling or actuating a fluorescent lamp, wherein an inactive fluorescent lamp can be detected if after a start-up phase a first signal is present at a first input and/or a second signal is present at a second input during a detection interval.

The fluorescent lamp will be inactive particularly if not yet ignited or if having been extinguished.

That approach to a detector circuit will allow flexible use for example in electronic ballasts that are connected differently and/or have a different number of fluorescent lamps.

The detection interval corresponds by way of example to a voltage interval in the range of approximately 2V to approximately 3V.

A development is for its being possible to determine during the start-up phase whether one fluorescent lamp or two fluorescent lamps is/are connected through the detector circuit's comparing the voltages at the inputs.

It should be noted in this regard that the start-up phase is of a duration required for coil monitoring and/or of a duration required for preheating the at least one fluorescent lamp. Preparatory measuring and monitoring operations can be performed during said start-up phase before the at least one fluorescent lamp is ignited.

It is a further development for the detector circuit to have been set up such that it can be determined

- that two fluorescent lamps are connected if the two voltages compared at the inputs during the start-up phase are approximately equal in magnitude,
- with just one fluorescent lamp otherwise being connected.

The detector circuit can hence detect automatically whether it has been employed in the one instance or the other.

Particularly when the voltages at the inputs differ roughly by a factor of two, it can be deduced that only one fluorescent lamp is being used. Both comparisons (the voltages at the inputs are approximately equal in magnitude or, as the case may be, the voltages at the inputs differ significantly (by approximately a factor of 2)) or just one of the two measurements can accordingly be used to determine whether one fluorescent lamp has been connected or whether two fluorescent lamps have been connected.

A further development is that

- if one fluorescent lamp is connected, actuating after the start-up phase can take place in keeping with at least one of the following criteria as a function of the first signal at the first input and as a function of the second signal at the second input:
  - if the first signal or second signal occurs in a first voltage interval, an output voltage will be reduced or an actuating frequency increased;
  - if the first signal or second signal occurs in a second voltage interval and the respective other signal occurs in a second or third voltage interval, the fluorescent lamp will be actuated with an ignition voltage;
  - if the first signal and second signal occur in the third voltage interval, the fluorescent lamp will be actuated, in particular an output voltage on the fluorescent lamp will be monitored;
  - if the first signal or second signal occurs in a fourth voltage interval, the output voltage will be reduced or the actuating frequency increased.

It should be noted that the aforementioned criteria can be employed singly or in combination.

It is an embodiment that

- if two fluorescent lamps are connected, actuating after the start-up phase can take place in keeping with at least one of the following criteria as a function of the first signal at the first input and as a function of the second signal at the second input:
  - if the first signal or second signal occurs in a first voltage interval, an output voltage will be reduced or an actuating frequency increased;
  - if the first signal and second signal occur in a second voltage interval, the fluorescent lamp will be actuated with an ignition voltage;
  - if exclusively the first signal or exclusively the second signal occurs in the second voltage interval and the respective other signal occurs in a third voltage interval, the fluorescent lamp will be actuated with a reduced ignition voltage;
  - if the first signal and second signal occur in the third voltage interval, the fluorescent lamp will be actuated, in particular an output voltage on the fluorescent lamp will be monitored;
  - if the first signal or second signal occurs in a fourth voltage interval, the output voltage will be reduced or the actuating frequency increased.

It should be herein noted that the formulation "exclusively the first signal or exclusively the second signal" corresponds to a logical EXOR-operation performed on the first and second signal.

The aforementioned reduction in the output voltage can also include the possibility that the at least one fluorescent lamp will not be actuated or the detector circuit and/or electronic ballast will be switched off.

It should be noted that the aforementioned criteria can be employed singly or in combination.

The voltage intervals are in particular arranged mutually adjoining. By way of example, the following voltage intervals can be employed:

First voltage interval: The voltage is greater than 3V;

Second voltage interval: The voltage is in a range of 2V to 3V (inclusive in each case);

Third voltage interval: The voltage is in a range of 0.5V up to and including 2V;

Fourth voltage interval: The voltage is less than 0.5V.

It is further a development that the at least one fluorescent lamp will be actuated in particular via at least one half-bridge inverter as a function of the first signal at the first input and as a function of the second signal at the second input if the first signal and second signal are during a start-up phase each greater than a first specified voltage and less than a second specified voltage.

The start-up phase is in particular a period of time before the at least one fluorescent lamp is actuated. It can be thus actuated by means of, for example, a half-bridge circuit (or a half-bridge inverter), by means of a full-bridge circuit, or by means of a push-pull circuit.

It should be herein noted that the first specified voltage is preferably less than the second specified voltage. In other words, the at least one fluorescent lamp will be actuated—directly or indirectly (for example via the at least one half-bridge inverter)—if the first and second signal each occur in an interval between the first specified voltage and second specified voltage.

Thus at least one coil of the at least one fluorescent lamp can advantageously be detected, with the detector circuit being able to be used in different EB topologies (lamp-to-ground or capacitor-to-ground connection modes) and in particular in combination with one fluorescent lamp or two fluorescent lamps.

It should be furthermore noted that the upper threshold corresponding to a high voltage (for example greater than the second specified voltage) on at least one of the two inputs can be equivalent to a high current flow in the detector circuit. For example the detector circuit can have a current source which in keeping with a high voltage of such kind imposes such a load on the detector circuit's supply voltage that the at least one fluorescent lamp can no longer be actuated. The high voltage on at least one of the two inputs hence alternatively or additionally corresponds to a high current that is converted by the current source from the supply voltage and stops the at least one fluorescent lamp from being actuated.

Another advantage of the present approach is that the detector circuit can be put to flexible use so that a multiplicity of otherwise necessary circuitry components for control and monitoring functions can be dispensed with.

It is thus a development that the second specified voltage is predefined by a current source.

It is particularly a development that at least one of the inputs is connected to the current source, with the current source imposing a load on a supply voltage as a function of at least one voltage on at least one of the inputs.

The current source is embodied as, for example, a controllable current source.

A development is for its to be possible to use the detector circuit for actuating the at least one fluorescent lamp before an electronic ballast starts.

Coil detecting is used preferably before an electronic ballast starts up or, as the case may be, before a fluorescent lamp is ignited.

It is a further development for the at least one fluorescent lamp not to be actuated, in particular via the at least one half-bridge inverter, if during the start-up phase the first signal or second signal is greater than the second specified voltage or if the first signal or second signal is less than the first specified voltage.

The coils have in that case not (yet) been correctly detected, the at least one fluorescent lamp will not yet be actuated or, as the case may be, the EB will in particular wait until the coils have been correctly contacted.

A particular advantage thereof is that the fluorescent lamp will not be ignited if inserted into a holder on one side only so that the user cannot receive an electric shock when, for example, the fluorescent lamp is being changed.

It is particularly a development that in the case of a connection mode having one fluorescent lamp, the first signal via a voltage divider corresponds to a voltage on the fluorescent lamp and the second signal via a voltage divider corresponds to a reference voltage;

in the case of a connection mode having two fluorescent lamps, the first signal via a voltage divider corresponds to a voltage on the first fluorescent lamp and the second signal via a voltage divider corresponds to a voltage on a second fluorescent lamp.

The detector circuit can hence advantageously be used in a connection mode having one fluorescent lamp or in a connection mode having two fluorescent lamps.

It is further a development that the at least one fluorescent lamp can be operated in a capacitor-to-ground topology or in a lamp-to-ground topology.

It is hence possible to use the detector circuit in different topologies, which is to say connection modes, of the at least one fluorescent lamp. The detector circuit will correctly deduce the requisite behavior or, as the case may be, the requisite control and monitoring functions in both kinds of connection mode.

An alternative embodiment variant is to provide comparators for determining the voltage intervals.

A next embodiment is for its being possible to determine the signals of the inputs by means of a microcontroller.

The comparators can accordingly be used with the associated switching logic for detecting the thresholds. At least one microcontroller, possibly in combination with at least one analog-to-digital converter (A/D converter), can alternatively or additionally be used to log and appropriately evaluate the signals at the inputs.

A further embodiment is for its being possible to actuate the at least one fluorescent lamp by means of at least one half-bridge via a voltage-controlled oscillator.

The at least one half-bridge or the voltage-controlled oscillator can for example be part of the detector circuit or part of the electronic ballast for operating the at least one fluorescent lamp. The detector circuit can in particular also be a part of the electronic ballast or be linked thereto.

A development is for at least one input to be connected to a controllable current source, with the controllable current source imposing a load on a supply voltage as a function of at least one voltage on at least one input.

The current source can to that extent as a function of a voltage on at least one of the inputs impose a load on the supply voltage in the form of a suitably high current so that, for example, the at least one fluorescent lamp will not be actuated (or, as the case may be, can no longer be actuated) owing to the high voltage on the relevant input.

Another embodiment is for the detector circuit to be embodied at least partially in the form of an integrated circuit.

The aforementioned object is achieved also by means of an electronic ballast for actuating at least one fluorescent lamp that includes a detector circuit as described herein.

The EB in particular provides functions for dimming the at least one fluorescent lamp and for end-of-life detecting. A fault incident occurring while a fluorescent lamp is operating can be promptly detected by means of the detector circuit and said lamp cease being actuated (meaning the fluorescent lamp can be switched to inactive).

A further embodiment is for its being possible to use the circuit arrangement for end-of-life detecting and for switching the fluorescent lamp off.

The aforementioned object is furthermore achieved by means of a circuit arrangement for actuating at least one fluorescent lamp, including:

- a half-bridge inverter having at least one downstream load circuit,
- at least one coupling capacitor that is connected to the load circuit and half-bridge inverter,
- with the load circuit having terminals for the at least one fluorescent lamp,
- a detector circuit as claimed in one of claims 1 to 15 for actuating the half-bridge inverter.

The aforementioned object is achieved also by means of a method for operating the detector circuit according to the explanations presented herein.

BRIEF DESCRIPTION OF THE DRAWINGS

In the drawings, like reference characters generally refer to the same parts throughout the different views. The drawings are not necessarily to scale emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
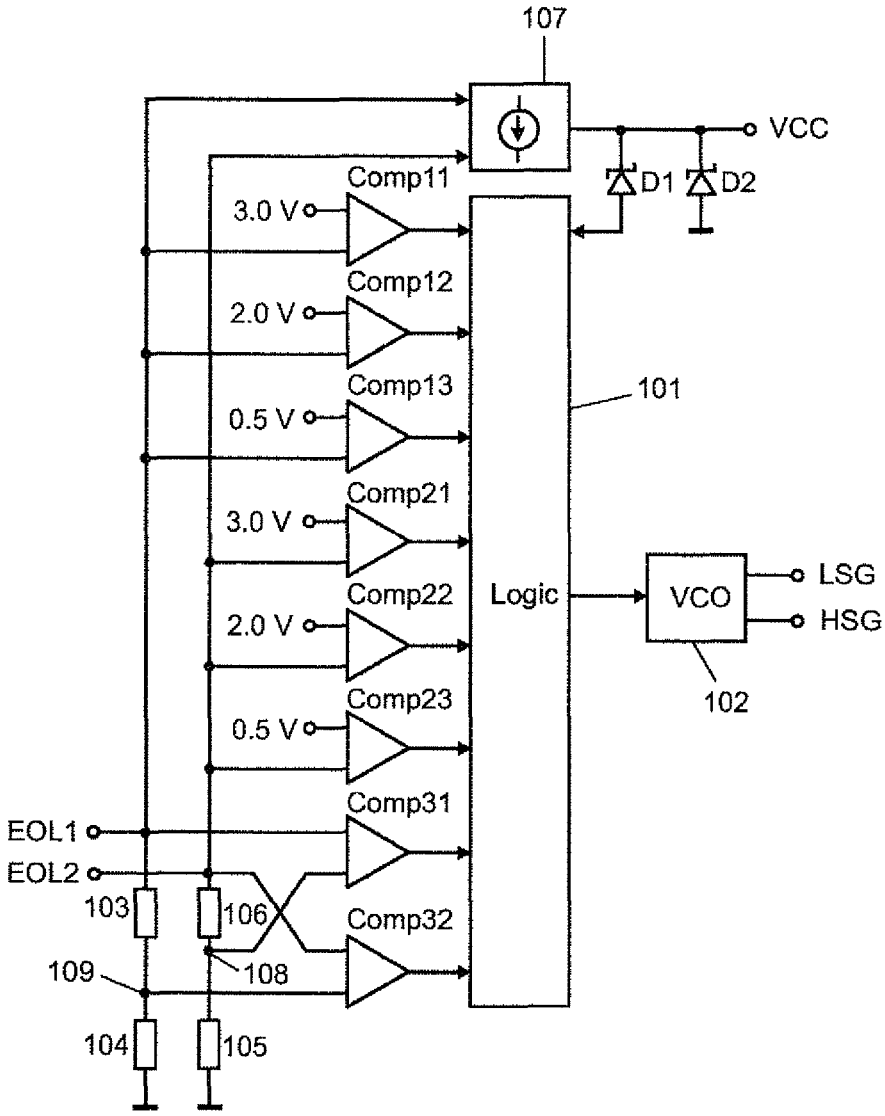
FIG. 1 shows by way of example a structure of a control circuit for actuating at least one fluorescent lamp.

FIG. 1 shows by way of example a structure of a control circuit for actuating at least one fluorescent lamp.

FIG. 1 includes a plurality of comparators Comp11, Comp12, Comp13, Comp21, Comp22, Comp23, Comp31, and Comp32 whose outputs are connected to a logic unit 101. Logic unit 101 drives a voltage-controlled oscillator VCO 102 provided at whose output are two drive signals LSG, HSG for example for actuating electronic switches of a half-bridge circuit or half-bridge inverter.

The control circuit can be part of an end-of-life circuit, in particular an end-of-life detector circuit for operating and/or monitoring at least one fluorescent lamp.

The control circuit can be part of an integrated circuit that can be used for actuating an electronic ballast (EB) or at least one half-bridge.

The control circuit as shown in FIG. 1 has two inputs EOL1, EOL2 as well as an input for a supply voltage VCC. Inputs EOL1 and EOL2 are both suitable for detecting a voltage on a fluorescent lamp or in connection therewith. The voltage that can be detected at in each case input EOL1 and/or EOL2 can be suitably evaluated by means of the control circuit.

The control circuit as shown in FIG. 1 is for that purpose embodied by way of example as follows: Input EOL1 is connected to an input of comparator Comp31, the other input of comparator Comp31 is connected to a node 108. Node 108 is connected to input EOL2 via a resistor 106. Node 108 is also connected via a resistor 105 to ground. Input EOL2 is furthermore connected to an input of comparator Comp32 whose other input is connected to a node 109. Node 109 is connected via a resistor 104 to ground and via a resistor to input EOL1.

Input EOL1 is connected to an input in each case of comparators Comp11, Comp12, and Comp13. The other input of comparator Comp11 is applied to a potential of 3V, the other input of comparator Comp12 is applied to a potential of 2V, and the other input of comparator Comp13 is applied to a potential of 0.5V.

Input EOL2 is connected to an input in each case of comparators Comp21, Comp22, and Comp23. The other input of comparator Comp21 is applied to a potential of 3V, the other input of comparator Comp22 is applied to a potential of 2V, and the other input of comparator Comp23 is applied to a potential of 0.5V.

By means of the comparators it can be determined in which of in each case at least four voltage ranges the input voltages at inputs EOL1 and EOL2 are located.

Input EOL1 is connected to an input of a current source 107 and input EOL2 is connected to another input of current source 107. The current source is furthermore connected to supply voltage VCC. Supply voltage VCC is connected via a Z diode D1 to logic unit 101 and a Z diode D2 is arranged between supply voltage VCC and ground.

Thus both inputs EOL1 and EOL2 or just one of the two inputs can be connected to controllable current source 107 which imposes a load on supply voltage VCC as a function of the voltages at inputs EOL1 and EOL2. Logic unit 101 will be enabled via Z diode D1 for actuating VCO 102 if the supply voltage VCC exceeds a specified value. Z diode D2 will prevent said supply voltage VCC from increasing any further.

Described below are exemplary circuit arrangements of electronic ballasts (EB) having one or two fluorescent lamps in different connection modes. Each of the circuit arrangements has the control circuit shown in FIG. 1 and explained above.

What basically applies to the circuit arrangements is that the fluorescent lamps shown do not have to be part of the EB but that preferably terminals (holders, for example) are provided that can be contacted with the fluorescent lamps.

EB Having a Fluorescent Lamp and a Capacitor-to-Ground Connection Mode

Figure 2:
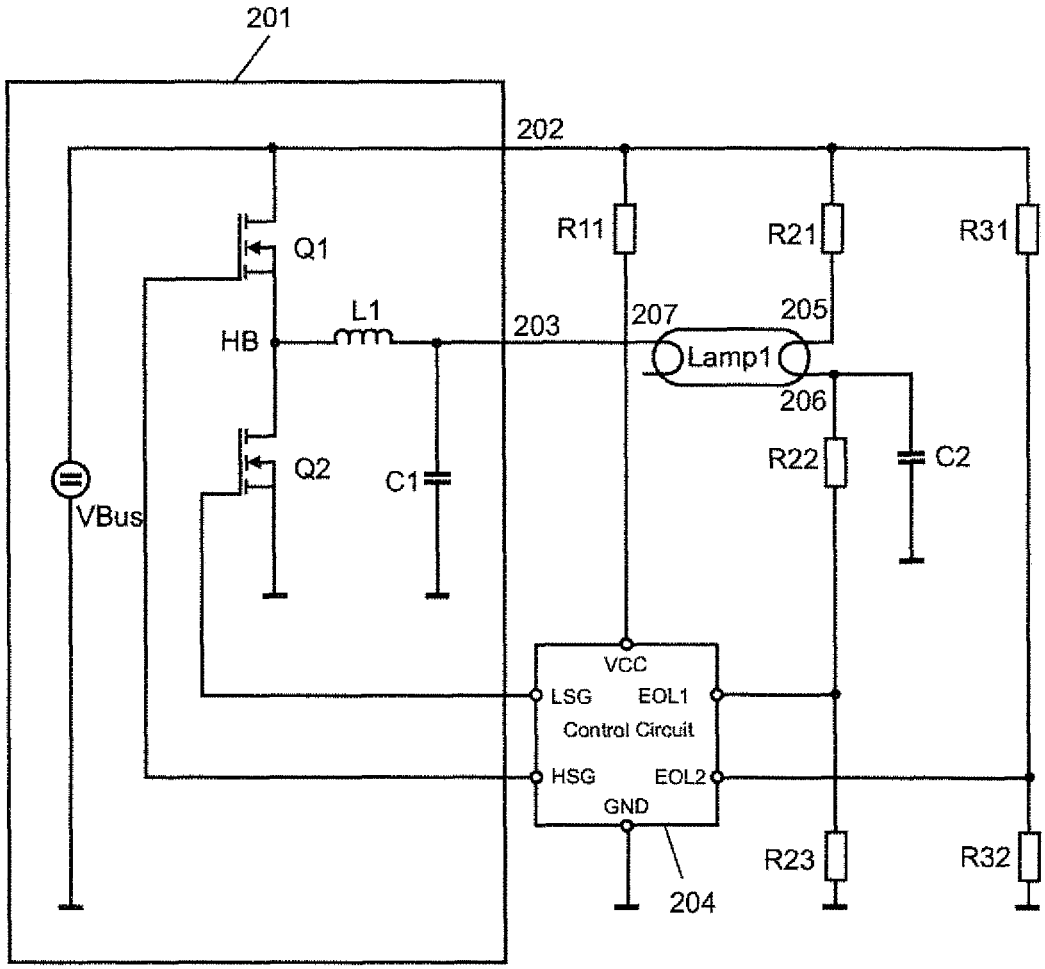
FIG. 2 shows an EB with one fluorescent lamp in a capacitor-to-ground topology.

FIG. 2 shows an EB having one fluorescent lamp in a capacitor-to-ground topology.

FIG. 2 shows a circuit block 201 that is also to be found in the circuit arrangements that follow where it is also designated as circuit block 201. Circuit block 201 is described below by way of example.

There is a supply voltage or intermediate-circuit voltage VBus between ground and a node 202. Node 202 is connected to the drain terminal of an n-channel MOS-FET Q1 whose source terminal is connected to a node HB and the drain terminal of an n-channel MOS-FET Q2. The source terminal of MOS-FET Q2 is connected to ground. The gate terminal of MOS-FET Q1 is connected to output LSG of control circuit 204 and the gate terminal of MOS-FET Q2 is connected to output HSG of control circuit 204. Node HB is connected to a node 203 via a coil L1 and node 203 is connected to ground via a capacitor C1.

Circuit block 201 is hence connected on the one hand to control circuit 204 and, on the other, via nodes 202 and 203 to the rest of the circuit arrangement.

Node 202 is according to FIG. 2 connected to the input for supply voltage VCC of control circuit 204 via a resistor R11. Node 202 is connected to a terminal 205 of the coil of lamp Lamp1 via a resistor R21. The coil's other terminal 206 is connected to input EOL1 via a resistor R22 and input EOL1 is connected to ground via a resistor R23. Terminal 206 is also connected to ground via a capacitor C2. Node 202 is connected to input EOL2 via a resistor R31 and input EOL2 is connected to ground via a resistor R32. Node 203 is connected to a terminal 207 of a coil of lamp Lamp1.

EB Having Two Fluorescent Lamps and a Capacitor-to-Ground Connection Mode

Figure 3:
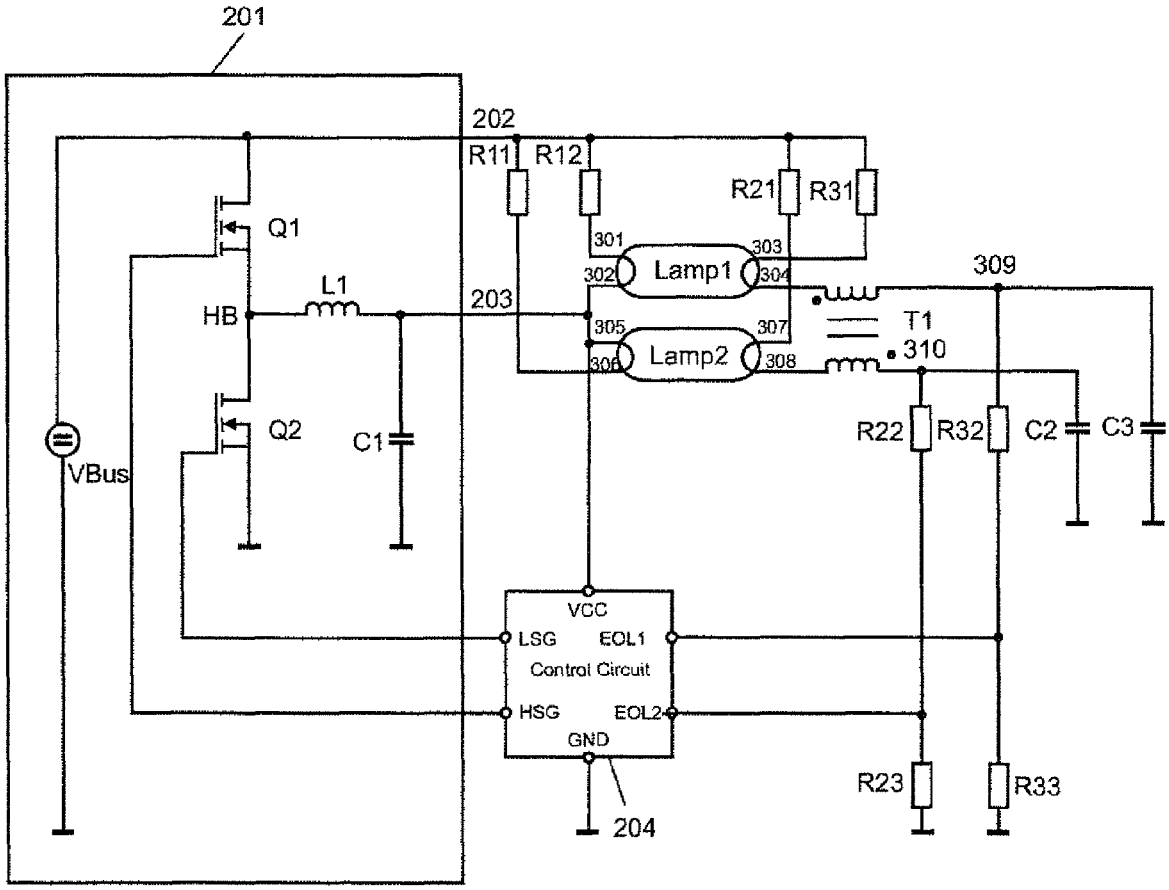
FIG. 3 shows an EB with two fluorescent lamps in a capacitor-to-ground topology.

FIG. 3 shows an EB having two fluorescent lamps in a capacitor-to-ground topology.

In keeping with what was said in connection with FIG. 2, circuit block 201 has been provided with the two nodes 202 and 203.

The EB is shown by way of example having two fluorescent lamps Lamp1 and Lamp2. They can therein be holders into which the fluorescent lamps are inserted. The fluorescent lamps each have two coils with two terminals each. Thus fluorescent lamp Lamp1 has terminals 301 and 302 for connecting to a first coil and terminals 303 and 304 for connecting to a second coil. Fluorescent lamp Lamp2 correspondingly has terminals 305 and 306 for connecting to a first coil and terminals 307 and 308 for connecting to a second coil.

Node 202 is connected via a resistor R11 to terminal 306, via a resistor R12 to terminal 301, via a resistor R21 to terminal 307, and via a resistor R31 to terminal 303.

Node 203 is connected to terminal 302, to terminal 305, and via a resistor R13 to the input for supply voltage VCC of control circuit 204.

Terminal 304 is connected via the first coil of a transformer T1 to a node 309 and terminal 308 is connected via the second coil of transformer T1 to a node 310.

Node 309 is connected via a capacitor C3 to ground. Node 309 is furthermore connected via a resistor R32 to input EOL1, with input EOL1 being connected to ground via a resistor R33.

Node 310 is connected via a capacitor C2 to ground. Node 310 is furthermore connected via a resistor R22 to input EOL2, with input EOL2 being connected to ground via a resistor R23.

EB Having a Fluorescent Lamp and a Lamp-to-Ground Connection Mode

Figure 4:
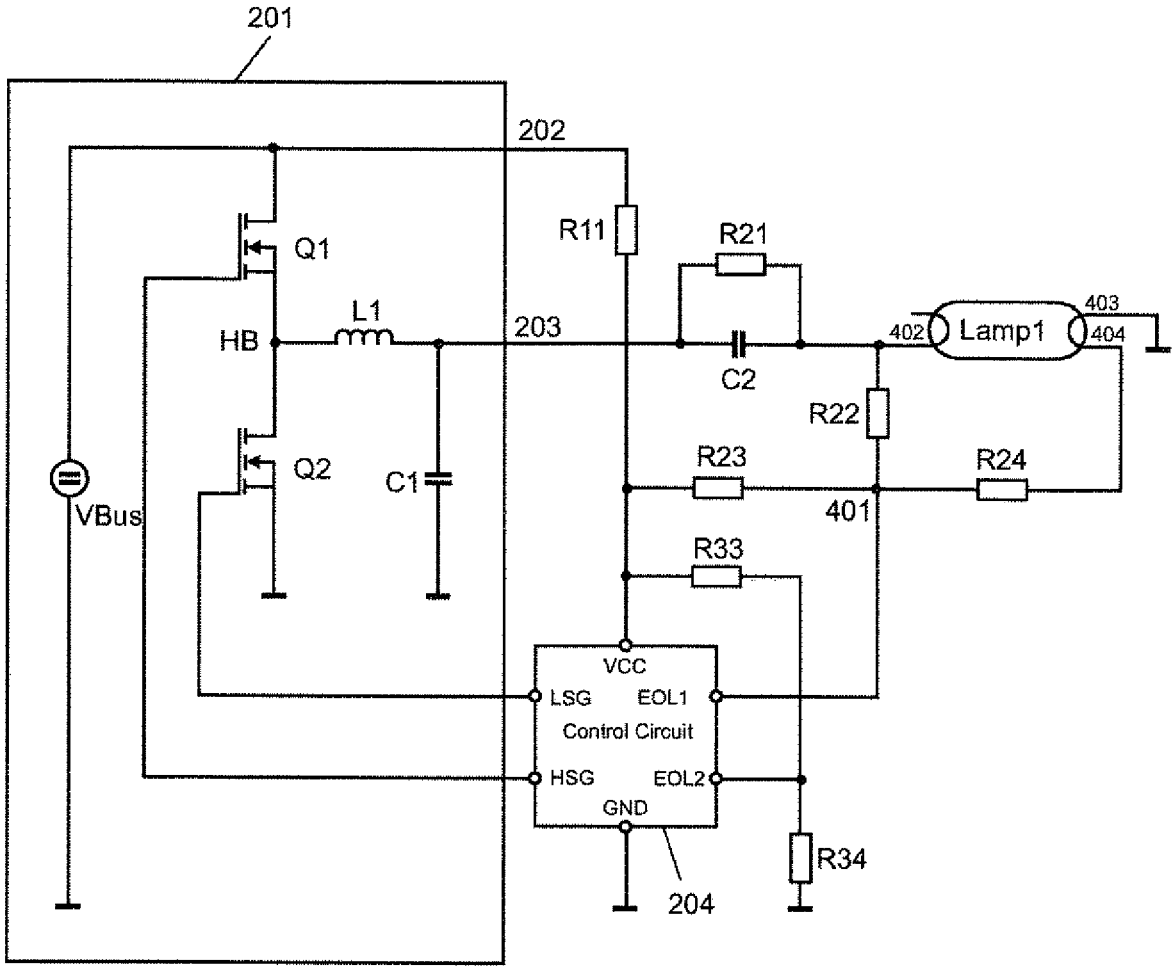
FIG. 4 shows an EB with one fluorescent lamp in a lamp-to-ground topology.

FIG. 4 shows an EB having one fluorescent lamp in a lamp-to-ground topology.

In keeping with what was said in connection with FIG. 2, circuit block 201 has been provided with the two nodes 202 and 203.

Node 202 is connected via a resistor R11 to the input for supply voltage VCC of control circuit 204.

The input of supply voltage VCC is connected via a resistor R23 to a node 401 and via a resistor R33 to input EOL2. Input EOL2 is connected via a resistor R34 to ground.

Node 203 is connected via a parallel circuit consisting of a resistor R21 and capacitor C2 to a terminal 402 for a first coil of a fluorescent lamp Lamp1 and via a resistor R22 to node 401. Node 401 is connected to input EOL1 and via a resistor R24 to a terminal 404 for a second coil of fluorescent lamp Lamp2. A terminal 403 for the fluorescent lamp's second coil is connected to ground.

EB Having Two Fluorescent Lamps and a Lamp-to-Ground Connection Mode

Figure 5:
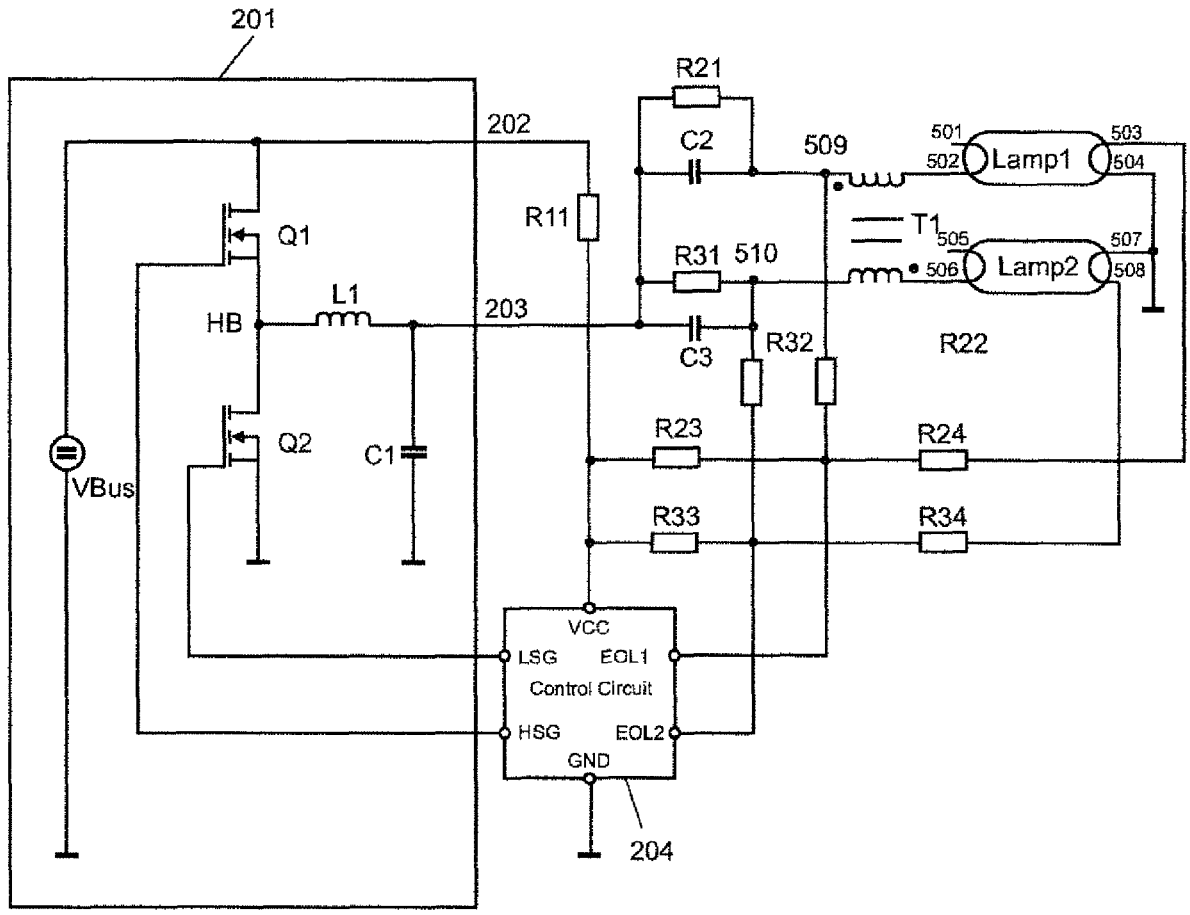
FIG. 5 shows an EB with two fluorescent lamps in a lamp-to-ground topology.

FIG. 5 shows an EB having two fluorescent lamps in a lamp-to-ground topology.

In keeping with what was said in connection with FIG. 2, circuit block 201 has been provided with the two nodes 202 and 203.

The EB is shown by way of example having two fluorescent lamps Lamp1 and Lamp2. They can therein be holders into which the fluorescent lamps are inserted. The fluorescent lamps each have two coils with two terminals each. Thus fluorescent lamp Lamp1 has terminals 501 and 502 for connecting to a first coil and terminals 503 and 504 for connecting to a second coil. Fluorescent lamp Lamp2 correspondingly has terminals 505 and 506 for connecting to a first coil and terminals 507 and 508 for connecting to a second coil.

Node 202 is connected via a resistor R11 to the input for supply voltage VCC of control circuit 204.

The input for supply voltage VCC of control circuit 204 is connected via a resistor R23 to input EOL1 and via a resistor R33 to input EOL2.

Node 203 is connected via a parallel circuit consisting of a resistor R31 and a capacitor C3 to a node 510 and via a parallel circuit consisting of a resistor R21 and a capacitor C2 to a node 509.

Node 509 is connected via a resistor R22 to input EOL1. Node 510 is connected via a resistor R32 to input EOL2.

Node 509 is furthermore connected via a first coil of a transformer T1 to terminal 502. Node 510 is connected via a second coil of transformer T1 to terminal 506.

Input EOL1 is connected via a resistor R24 to terminal 503 and input EOL2 is connected via a resistor R34 to terminal 508. The two terminals 504 and 507 are connected to ground.

Dimensioning the Voltage Dividers

The voltage dividers (R21, R22 or R31, R32) connected to a coil of the fluorescent lamp and to a coupling capacitor (C2, C3) are set such that said coil's potential will be significantly above that of node HB, being for example around 360V while the electronic ballast is operating (VBus=400V, half-bridge transistors actuated, potential at node HB around 200V averaged over time), during the time the lamp is not burning.

Said coil's potential is divided down further and ducted to an EOL input with the result that the voltage at said EOL input will exceed 2V while the EB is operating during the time the lamp is not burning (the lamp's resistance is infinitely great in that case) and will fall below 2V after the lamp has ignited (the lamp's resistance is in that case in a range of 100Ω to 100 kΩ, for example).

In the circuit arrangements having just one fluorescent lamp (FIG. 2, FIG. 4), input EOL2 is connected to a voltage divider that divides a fixed voltage in such a way that both inputs EOL1 and EOL2 will have (roughly) the same input voltage while the lamp is operating with a high power output (the lamp's resistance is in a range of 100Ω to 1 kΩ, for example).

In the circuit arrangement as shown in FIG. 2, intermediate-circuit voltage VBus is used for that because the voltage at input EOL1 is also dependent on intermediate-circuit voltage VBus. Supply voltage VCC is accordingly divided in the circuit arrangement as shown in FIG. 4 because the voltage at EOL1 here depends on said supply voltage VCC.

Coil Interrogating

An EB that has switched off owing to a lamp fault should restart automatically when the lamp has been changed.

At least one of the two lamp coils' electric continuity is checked for that purpose: The switch-off function can be reset if the coil has been interrupted and the EB can restart when continuity has been reestablished.

For safety reasons it is advantageous for the EB not to start if the lamp has been inserted only on one side in a holder in which ignition voltage is supplied. Were the terminals on the lamp's other side to be touched in such a situation, the lamp would otherwise ignite and could cause an electric shock.

The ignition voltage is supplied on a holder that is connected to the resonant circuit (L1, C1). In a case where the EB has two fluorescent lamps (FIG. 3, FIG. 5), said voltage is furthermore supplied on a holder that is connected to transformer T1 (balancing transformer). The lamp coils respectively opposite said holders are preferably checked for electric continuity.

Coil interrogating takes place preferably before or, as the case may be, when the EB starts up. The half-bridge transistors (Q1, Q2) will in that case not yet be actuated and the intermediate-circuit voltage (VBus) will be in a range of, for instance, 176V to 375V depending on the system voltage. The lamps (Lamp1, Lamp2) are not yet burning (meaning that the respective lamp's resistance is infinitely large).

The voltage at inputs EOL1 and EOL2 will be in a range of approximately 0.5V to approximately 3V with the coils inserted and if they are in order.

If, by contrast, a coil is missing, the relevant voltage at inputs EOL1 and EOL2 in the circuits as shown in FIG. 2 and FIG. 3 will in each case be 0V and in the circuits as shown in FIG. 4 and FIG. 5 the voltage at inputs EOL1 and EOL2 will be greater than 3V. The EB must not start up in either case (0V and greater than 3V). The EB will not start up unless the voltages at inputs EOL1 and EOL2 are in a range of 0.5V to 3V.

The table below summarizes coil interrogating before the EB starts up:

| Inputs | Condition | Cause | Reaction |
|---|---|---|---|
| EOL1 OR EOL2 | >3 V | Coil missing | wait |
| EOL1 AND EOL2 | 0.5 V-3 V | Coils ok | start up |
| EOL1 OR EOL2 | <0.5 V | Coil missing | wait |

The first column in the above table shows which input(s) EOL1 and/or EOL2 fulfill(s) the conditions according to the second voltage. Depending on the state of the voltages at input(s) EOL1 and/or EOL2, the third column shows the cause and the fourth column presents the reaction of the detector circuit or that of the EB.

The circuit as shown in FIG. 3 includes a special case: Here, monitoring of all four coils of both lamps is expediently required. The control circuit's supply current is for that purpose ducted via resistors R11 and R12 and via both coils (terminals 301, 302 and 305, 306) on the lamp side of the resonant circuit. Resistors R11 and R12 can be embodied as being the same size as and twice the size of resistor R13 to keep the losses small. The supply current will drop to ⅔ of its normal value if one of the two coils is missing. The control circuit's supply current is made independent of the system voltage to enable such a small change to be evaluated in the case of a large system-voltage range of between 176V and 375V. That is achieved by means of current source 107, which imposes an additional load on the supply as a function of the system voltage (see FIG. 1 and associated description). The EB will only start up if the control circuit's remaining supply current does not fall below a certain minimum value (for example 150 μA).

Current source 107 is controlled either by the larger of the voltages at inputs EOL1 and EOL2, which are each proportional to intermediate-circuit voltage VBus, or by the voltage at input EOL1.

It is hence advantageous that at least one missing coil of a fluorescent lamp can be detected in a lower and upper voltage range so that the control circuit can be universally employed for different EB topologies (lamp-to-ground connection mode, capacitor-to-ground connection mode).

Ignition Control

If a lamp is not yet burning or if a lamp goes out for any reason while it is operating, it has to be ignited.

The necessary ignition voltage—up to 750V depending on the lamp—has to be provided by the EB for that. A lamp that is not burning is detected from the fact that the voltage at the relevant input EOL1 and/or EOL2 is more than 2V but less than 3V.

In the case particularly of a dimmable EB having two lamps, one lamp's ignition voltage will be almost doubled by balancing transformer T1 if the other lamp is already burning.

There will in that condition be a heavy load on balancing transformer T1 due to the high voltage and intense driving of the core. It is therefore expedient to reduce the ignition voltage while said condition persists.

The voltage at one of inputs EOL1 or EOL2 will in that case be in a range of 0.5V to 2V; the voltage at the other input EOL2 or EOL1 will be in a range between 2V and 3V (comparable to the case where the EB has just one lamp when that sole lamp is not burning).

To make a correct reaction possible it must preferably be established whether the control circuit is being operated with one lamp or with two lamps. It will be possible to determine that particularly while no lamp(s) is/are yet burning, meaning during a pre-heating phase: The voltages at inputs EOL1 and EOL2 will differ by a factor of approximately 2 in the case of the EB having one lamp; in the case of the EB having two lamps, the voltages at inputs EOL1 and EOL2 will be approximately equal in magnitude during the pre-heating phase. The voltages and their relation to each other can be determined by means of the control circuit, using comparators Comp31 and Comp32, for example (see FIG. 1).

Monitoring Output Voltage $U_{out}$

While the EB is operating normally (lamp is burning) its output voltage ought not permanently to exceed a specific value, for example 300V or 430V.

To ensure that, the same controlled variable can be used as for ignition controlling, although the sensitivity can be increased accordingly.

The "normal operation" condition can be detected by means of the voltages at inputs EOL1 and EOL2; both will then be in a range of 0.5V to 2V.

Hard rectifier operation as is being checked according to EN 61000-3-2 constitutes a particular load for the EB. A diode is here connected in series with the lamp and the charge on the coupling capacitor (C2, C3) forcefully reversed thereby. In that operating mode the load on the EB can be reduced through the operating frequency's being increased (far) above the resonant frequency of the output-resonant circuit (L1, C1).

The tables below show a possible way of ignition controlling and monitoring the output voltage of an EB when it has started up for the case where the EB has one lamp:

| Inputs | Condition | Cause | Reaction |
|---|---|---|---|
| 1 OR 2 | >3 V | Hard rectifying | Increase frequency |
| 1 OR 2 | 2 V-3 V | Lamp not burning | Full ignition voltage |
| 1 AND 2 | 0.5 V-2 V | Normal operation | Monitor $U_{out}$ |
| 1 OR 2 | <0.5 V | Hard rectifying | Increase frequency |

and for the case where the EB has two lamps:

| Inputs | Condition | Cause | Reaction |
|---|---|---|---|
| 1 OR 2 | >3 V | Hard rectifying | Increase frequency |
| 1 AND 2 | 2 V-3 V | Neither lamp is burning | Full ignition voltage |
| 1 EXOR 2 | 2 V-3 V | One lamp is not burning | Reduced ignition voltage |
| 1 AND 2 | 0.5 V-2 V | Normal operation | Monitor $U_{out}$ |
| 1 OR 2 | <0.5 V | Hard rectifying | Increase frequency |

The same comparator thresholds can be used for the functions coil interrogating, ignition controlling, and monitoring the output voltage. The respective circuit's structure will be simplified thereby. It is also possible to provide separate comparator thresholds for each functionality (or parts thereof).

Instead of the comparators and switching logic it is possible also to provide a microcontroller having an A/D converter that appropriately evaluates the signals at inputs EOL1 and EOL2 and actuates the at least one half-bridge or, as the case may be, at least one fluorescent lamp accordingly.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A detector circuit for controlling at least one fluorescent lamp, wherein the detector circuit is configured such that an inactive fluorescent lamp can be detected if a first signal is present at a first input and a second signal is present at a second input in a detection interval after a start-up phase, wherein the detector circuit is configured such that can be determined during the start-up phase whether one fluorescent lamp or two fluorescent lamps is/are connected through the detector circuit's comparing the voltages at the inputs, and wherein the detector circuit is configured such that the detector circuit can determine that two fluorescent lamps are connected if the two voltages compared at the inputs during the start-up phase are approximately equal in magnitude, with just one fluorescent lamp otherwise being connected.

2. The detector circuit as claimed in claim 1, wherein if one fluorescent lamp is connected, actuating after the start-up phase can take place in keeping with at least one of the following criteria as a function of the first signal at the first input and as a function of the second signal at the second input:

If the first signal or second signal occurs in a first voltage interval, an output voltage will be reduced or an actuating frequency increased;

if the first signal or second signal occurs in a second voltage interval and the respective other signal occurs in a second or third voltage interval, the fluorescent lamp will be actuated with an ignition voltage;

if the first signal and second signal occur in the third voltage interval, the fluorescent lamp will be actuated;

if the first signal or second signal occurs in a fourth voltage interval, the output voltage will be reduced or the actuating frequency increased.

3. The detector circuit as claimed in claim 1, wherein if two fluorescent lamps are connected, actuating after the start-up phase can take place in keeping with at least one of the following criteria as a function of the first signal at the first input and as a function of the second signal at the second input:

If the first signal or second signal occurs in a first voltage interval, an output voltage will be reduced or an actuating frequency increased;

if the first signal and second signal occur in a second voltage interval, the fluorescent lamp will be actuated with an ignition voltage;

if exclusively the first signal or exclusively the second signal occurs in the second voltage interval and the respective other signal occurs in a third voltage interval, the fluorescent lamp will be actuated with a reduced ignition voltage;

if the first signal and second signal occur in the third voltage interval, the fluorescent lamp will be actuated;

if the first signal or second signal occurs in a fourth voltage interval, the output voltage will be reduced or the actuating frequency increased.

4. The detector circuit as claimed in claim 1, wherein the at least one fluorescent lamp will be actuated as a function of the first signal at the first input and as a function of the second signal at the second input if the first signal and second signal are during a start-up phase each greater than a first specified voltage and less than a second specified voltage.

5. The detector circuit as claimed in claim 4, wherein the second specified voltage is predefined by a current source.

6. The detector circuit as claimed in claim 5, wherein at least one of the inputs is connected to the current source, with the current source imposing a load on a supply voltage as a function of at least one voltage on at least one of the inputs.

7. The detector circuit as claimed in claim 4, configured to actuate the at least one fluorescent lamp before an electronic ballast starts.

8. The detector circuit as claimed in claim 4, wherein the detector circuit is configured such that the at least one fluorescent lamp will not be actuated if during the start-up phase the first signal or second signal is greater than the second specified voltage or if the first signal or second signal is less than the first specified voltage.

9. The detector circuit as claimed in claim 4, wherein in the case of a connection mode having one fluorescent lamp, the first signal via a voltage divider corresponds to a voltage on the fluorescent lamp and the second signal via a voltage divider corresponds to a reference voltage;

wherein in the case of a connection mode having two fluorescent lamps, the first signal via a voltage divider corresponds to a voltage on the first fluorescent lamp and the second signal via a voltage divider corresponds to a voltage on a second fluorescent lamp.

10. The detector circuit as claimed in claim 1, wherein the at least one fluorescent lamp can be operated in a capacitor-to-ground or in a lamp-to-ground topology.

11. The detector circuit as claimed in claim 1, wherein the at least one input is connected to a controllable current source, with the controllable current source imposing a load on a supply voltage as a function of at least one voltage on at least one input.

* * * * *